US009567695B2

(12) United States Patent
Shimbara

(10) Patent No.: US 9,567,695 B2
(45) Date of Patent: Feb. 14, 2017

(54) COMBING CYLINDER FOR COMBER

(71) Applicant: KABUSHIKI KAISHA TOYOTA JIDOSHOKKI, Kariya-shi, Aichi-ken (JP)

(72) Inventor: Masami Shimbara, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 148 days.

(21) Appl. No.: 14/560,637

(22) Filed: Dec. 4, 2014

(65) Prior Publication Data

US 2015/0167203 A1 Jun. 18, 2015

(30) Foreign Application Priority Data

Dec. 12, 2013 (JP) ..... 2013-257122

(51) Int. Cl.
*D01G 19/10* (2006.01)

(52) U.S. Cl.
CPC ..... *D01G 19/105* (2013.01)

(58) Field of Classification Search
CPC ..... D01G 19/10; D01G 19/105
See application file for complete search history.

(56) References Cited

U.S. PATENT DOCUMENTS 1,719,730 A * 7/1929 Schoenfeld ..... C08B 5/02 242/118.11
4,394,789 A * 7/1983 Egerer ..... D01H 4/32 19/114
4,498,217 A * 2/1985 Engels ..... D06C 13/08 26/9
4,627,131 A * 12/1986 Iwata ..... D01H 4/32 19/112
4,716,629 A * 1/1988 Iwata ..... D01G 19/105 19/114
4,941,314 A 7/1990 Odawara
5,038,440 A * 8/1991 Demuth ..... D01G 15/88 19/114
5,113,559 A * 5/1992 LaRoche ..... D01H 4/32 19/112
9,145,626 B2 * 9/2015 Muller ..... D01G 19/105
(Continued)

FOREIGN PATENT DOCUMENTS

CN 200974881 Y 11/2007
DE 10163663 A1 7/2003
(Continued)

OTHER PUBLICATIONS

Communication dated Sep. 29, 2015 from the Japanese Patent Office issued in corresponding application No. 2013-257122.
(Continued)

*Primary Examiner* — Shaun R Hurley
(74) *Attorney, Agent, or Firm* — Sughrue Mion, PLLC

(57) ABSTRACT

A combing cylinder of a comber includes a base and comb segments. The base includes mounting slots. Each comb segment includes a needle array and is detachably secured to the base via the associated mounting slot. The sizes of the needle arrays vary from one comb segment to another. The combing cylinder includes a cover. When at least one of the comb segments is detached from the base, the cover is mounted on the base to cover the mounting slot corresponding to the detached comb segment.

2 Claims, 3 Drawing Sheets

(56) References Cited

U.S. PATENT DOCUMENTS

| | | | | |
|---|---|---|---|---|
| 2012/0030907 | A1* | 2/2012 | Henninger | D01G 19/105<br>19/122 |
| 2013/0263408 | A1* | 10/2013 | Muller | D01G 19/105<br>19/234 |

FOREIGN PATENT DOCUMENTS

| | | | |
|---|---|---|---|
| EP | 1533404 | A1 | 5/2005 |
| JP | 57-56524 | A | 4/1982 |
| JP | 0278580 | U | 6/1990 |
| JP | 03-22072 | U | 3/1991 |
| JP | 2003041440 | A | 2/2003 |
| JP | 2005-146501 | A | 6/2006 |

OTHER PUBLICATIONS

Communication dated May 6, 2015, issued by the European Patent Office in corresponding European Application No. 14194617.8.

* cited by examiner

COMBING CYLINDER FOR COMBER

BACKGROUND OF THE INVENTION

The present invention relates to a combing cylinder for a comber, and more specifically, to a combing cylinder for a comber including multiple replaceable comb segments.

A comber includes a working portion provided with multiple (typically, eight) combing heads. The combing heads perform a series of operation to form slivers from raw material, or laps. FIG. 5 shows a combing head 51 including a combing cylinder 54 and a nipper 53 having a feed roller 52. The combing head 51 further includes two pairs of detaching rollers 55, 56 arranged adjacent to each other in the front and rear direction of the combing head 51. The nipper 53 includes a nipper frame 57 arranged to reciprocate in the front and rear direction of the combing head 51 above the combing cylinder 54. The nipper 53 also includes a bottom nipper 58 located at the bottom of the nipper frame 57.

A nipper frame driving arm 59 pivots back and forth, or swings, together with a nipper shaft 60. This swinging motion reciprocates the nipper frame 57 such that the distal end of the bottom nipper 58 approaches and separates from the detaching rollers 55. The nipper frame 57 rotationally supports a nipper arm 61. The nipper arm 61 has a top nipper 61*a* secured to its distal end. The top nipper 61*a* approaches and separates from the bottom nipper 58 at predetermined timing in synchronization with the reciprocation of the nipper frame 57, and clamps a lap L in cooperation with the bottom nipper 58. The nipper frame 57 has a top comb 62 mounted such that the top comb 62 moves in a predetermined manner in synchronization with the nipper frame 57 in front of the bottom nipper 58.

Below the combing cylinder 54 is provided a brush 63, and below the brush 63 is provided a non-illustrated suction duct. The combing cylinder 54 and the top comb 62 remove, for example, short fibers and neps from the lap L, which are then sucked into the suction duct.

The combing cylinder 54 uses different kinds of needle arrays (teeth) in accordance with the kind of cotton and the required sliver quality. The combing cylinder 54 typically uses a circular comb including four rows of needle arrays. To respond to a demand for higher sliver quality or to further improve the productivity of the sliver, the combing cylinder 54 including five rows of needle arrays needs to be used.

FIG. 6 shows a combing cylinder 54 disclosed in Japanese Laid-Open Patent Publication No. 2005-146501. The combing cylinder 54 includes multiple comb segments 66 with needle arrays 66*a* detachably secured to a support 67. The sizes of the needle arrays 66*a* vary from one comb segment 66 to another. Each comb segment 66 includes a slot 66*b* on the end opposite to the end where the needle array 66*a* is arranged. The width of the slot 66*b* increases toward the needle array 66*a*. The support 67 has slots 67*a* formed on its surface to extend in the axial direction of the combing cylinder 54. Each slot 67*a* accommodates a mounting member 68 arranged to protrude from the slot 67*a* of the support 67. Each comb segment 66 is secured to the support 67 via the mounting member 68 including a fitting portion that fits with the slot 66*b* of the comb segment 66. The support 67 includes bolt insertion holes 69 formed to correspond to the slots 67*a*. Each bolt insertion hole 69 receives a bolt 70 from the opening farther from the slot 67*a* toward the slot 67*a*. The mounting member 68 includes threaded bores and is secured to the support 67 by screwing the bolts 70 in the threaded bores. The combing cylinder 54 rotates in the direction indicated by the arrow in FIG. 6, that is, clockwise.

In accordance with the kind of raw cotton and the required quality of the sliver to be spun, the combing cylinder 54 is used either with all the comb segments 66 secured to the support 67 or with one or some of the comb segments 66 detached.

When the combing cylinder 54 of Japanese Laid-Open Patent Publication No. 2005-146501 is used with four of the comb segments 66, the comb segment 66 located at the trailing end of the combing cylinder 54 is detached. In the slot 67*a* of the support 67 from which the comb segment 66 is removed, foreign object such as cotton fly accumulates, but cannot be cleaned with the brush 63. When a certain amount of foreign object builds up in the slot 67*a*, the foreign object mixes into a web (wide fiber bundle) and significantly deteriorates the sliver quality.

SUMMARY OF THE INVENTION

Accordingly, it is an objective of the present invention to provide a combing cylinder for a comber that prevents the sliver quality from significantly deteriorating when the combing cylinder is used with one or some of comb segments detached.

To achieve the foregoing objective and in accordance with one aspect of the present invention, a combing cylinder for a comber is provided that includes a base including a plurality of mounting slots, a plurality of comb segments, and a cover. Each of the comb segments includes a needle array and is detachably secured to the base via the associated mounting slot. The sizes of the needle arrays vary from one comb segment to another. When at least one of the comb segments is detached from the base, the cover is mounted on the base to cover the mounting slot corresponding to the detached comb segment.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1A to 2C.

Figure 1A:
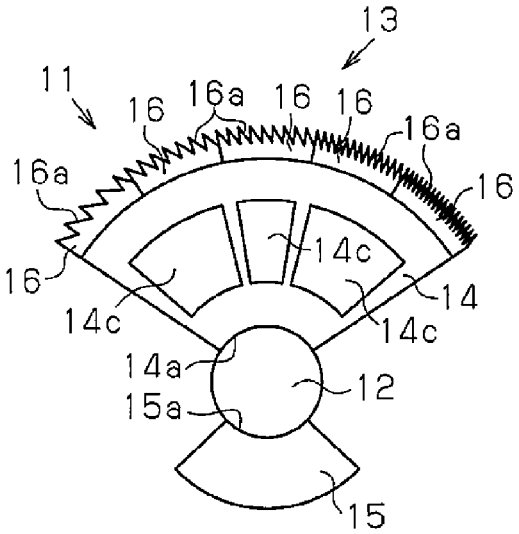
FIG. 1A is a side view illustrating a combing cylinder according to a first embodiment.
Figure 1B:
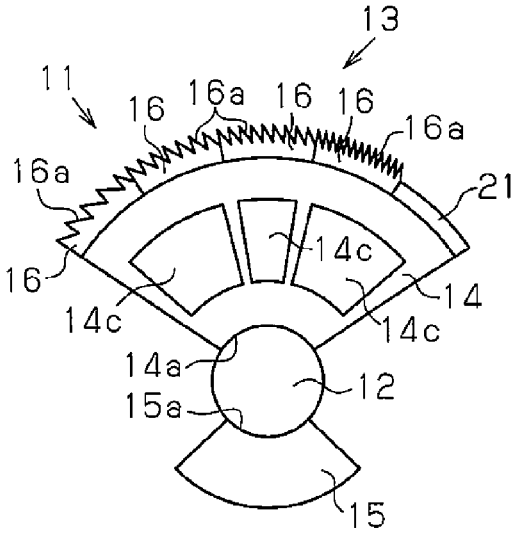
FIG. 1B is a side view illustrating a state where one of the comb segments is replaced with a cover in the combing cylinder of FIG. 1A.

FIGS. 1A and 1B show a combing cylinder 11 for a comber that includes a base 14. The base 14 is directly attached to a cylinder shaft 12 and supports combing needles (card clothing) 13 on the outer circumferential surface of the base 14. The combing cylinder 11 also includes a balance weight 15 directly attached to part of the cylinder shaft 12 farthest from the part where the base 14 is mounted.

The base 14 has a substantially sectorial side face. The base 14 is secured to the cylinder shaft 12 with an inner surface 14*a* of the base 14 abutting against the outer circumferential surface of the cylinder shaft 12 using non-illustrated fixing bolts. The balance weight 15 has a substantially sectorial side face. The balance weight 15 is fixed to the cylinder shaft 12 with an inner surface 15*a* of the balance weight 15 abutting against the outer circumferential surface of the cylinder shaft 12 using non-illustrated fixing bolts. The balance weight 15 opposes the base 14 with the cylinder shaft 12 located in between.

Figure 2A:
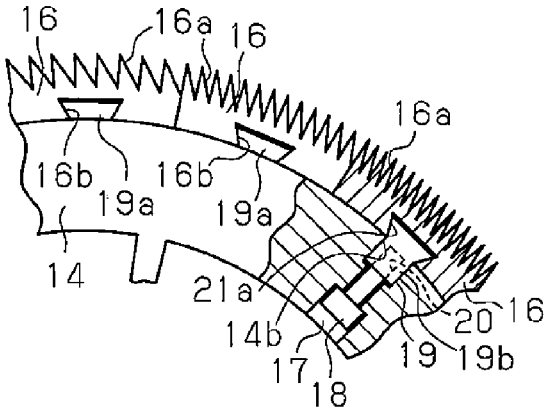
FIG. 2A is a partial cross-sectional view illustrating a state where the comb segments are secured to the combing cylinder of FIG. 1A.
Figure 2B:
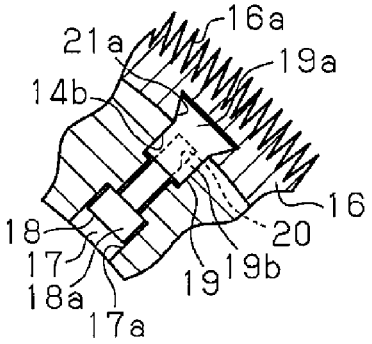
FIG. 2B is a partially enlarged view of FIG. 2A.

Multiple (five in the first embodiment) comb segments 16 forming the combing needles 13 are detachably secured to the base 14. The comb segments 16 each have a needle array (teeth) 16*a*, the size of which varies from one comb segment 16 to another. As shown in FIGS. 2A and 2B, each comb segment 16 has a slot 16*b* on the side opposite to the side where the needle array 16*a* is arranged, and the width of the slot 16*b* increases toward the needle array 16*a*. The slots 16*b* are not depicted in FIGS. 1A and 1B.

Multiple mounting slots 14*b* for mounting the comb segments 16 are formed in the outer circumferential surface of the base 14 to extend in the axial direction of the combing cylinder 11. The base 14 also has bolt through holes 17 that extend from hollow portions 14*c* to the mounting slots 14*b*. Each bolt through hole 17 includes a recess 17*a* having a larger diameter than the other portion on an end facing the hollow portion 14*c*. Each recess 17*a* accommodates a head 18*a* of a bolt 18.

Each comb segment 16 is mounted on the base 14 using a mounting member 19 and a bolt 18. The mounting member 19 includes a fitting portion 19*a* fitted to the slot 16*b* of the comb segment 16 and a mounting portion 19*b* mounted to the mounting slot 14*b* of the base 14. The mounting portion 19*b* has a threaded bore 20 at a position corresponding to the bolt through hole 17. Each bolt 18 is inserted in the associated bolt through hole 17 from the hollow portion 14*c* and is screwed to the associated threaded bore 20 so that the mounting member 19 is tightened to the base 14.

Figure 2C:
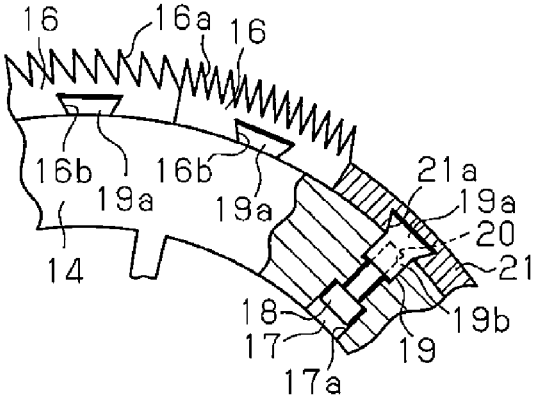
FIG. 2C is a partial cross-sectional view illustrating the combing cylinder of FIG. 1B in the state where the cover is secured.

A cover 21 that covers the mounting slot 14*b* is mountable to the base 14. When any of the comb segments 16 is detached from the base 14, the cover 21 is mounted on the base 14. As shown in FIGS. 1B and 2C, the cover 21 is shaped like the comb segment 16 without the needle array 16*a*. The cover 21 has a slot 21*a* at a portion facing the base 14. The width of the slot 21*a* increases in a direction away from the base 14. The slot 21*a* has the same shape and the size as the slot 16*b* of the comb segment 16 and is fitted to the fitting portion 19*a* of the mounting member 19. The cover 21 weighs the same as the comb segment 16 to be detached. The cover 21 is formed of material having a greater specific gravity than the material of the comb segment 16 and has a height less than that of the needle array 16*a*.

Operation of the combing cylinder 11 formed as described above will now be described.

The comber performs combing in an appropriate manner corresponding to spinning requirements by determining which of the combing needles 13, or the comb segments 16, to use in accordance with the kind of cotton and the required sliver quality. In the first embodiment, when the five comb segments 16 are used as the combing needles 13, the range of the base 14 covered by all the needle arrays 16*a* is 112.5° (112.5°=22.5°×5). When four of the comb segments 16 are used as the combing needles 13 in accordance with the kind of cotton and the required sliver quality, one of the comb segments 16 that includes the needle array 16*a* with the smallest needles is detached from the base 14. In this case, the range of the base 14 covered by all the needle arrays 16*a* is 90° (90°=22.5°×4).

When four of the comb segments 16 are used, the cover 21 is mounted on the portion where one of the comb segments 16 is detached. Such a replacement of the comb segment 16 with the cover 21 is performed as follows. For example, with the bolt 18 loosened and the comb segment 16 abutting against the base 14, the comb segment 16 is moved along the mounting slot 14*b* in the axial direction of the combing cylinder 11 so that the comb segment 16 is detached from the base 14. Then, with the slot 21*a* engaged with the fitting portion 19*a* of the mounting member 19, the cover 21 is moved along the mounting slot 14*b* in the axial direction of the combing cylinder 11. When the cover 21 is moved to the position where the entire cover 21 corresponds to the base 14, the bolt 18 is tightened. In this manner, the cover 21 is secured to the base 14 with the slot 21*a* fitted to the fitting portion 19*a*.

Depending on the weight of the cover 21, the balance weight 15 needs to be changed when the comb segment 16 is replaced with the cover 21 to adjust the rotational balance of the combing cylinder 11 after the replacement. However, the balance weight 15 does not need to be changed when the comb segment 16 is replaced with the cover 21 because the cover 21 has the same weight as the comb segment 16 to be detached.

The combing cylinder 11 performs combing with one of the comb segments 16 detached from the base 14 and the mounting slot 14*b* being covered with the cover 21. Thus, foreign object such as cotton fly is prevented from accumulating in the mounting slot 14*b* during operation of the comber. If the fifth comb segment 16 is necessary again in accordance with the kind of cotton and the required sliver quality, the detached comb segment 16 is replaced with the cover 21.

The first embodiment has the following advantages.

(1) The multiple comb segments 16 are detachably secured to the base 14 of the combing cylinder 11 and have the needle arrays 16*a*, the sizes of which vary from one comb segment 16 to another. Furthermore, the comb segments 16 are secured to the base 14 via the mounting slots 14*b* formed in the base 14. When any of the comb segments 16 is detached, the cover 21, which covers the associated mounting slot 14*b*, is mounted on the base 14. This prevents the sliver quality from significantly deteriorating when the combing cylinder 11 is used with one of the comb segments 16 detached.

(2) The cover 21 weighs the same as the comb segment 16 to be detached. This structure prevents the rotational balance of the combing cylinder 11 from being changed when the cover 21 is secured to the base 14 instead of the detached comb segment 16. For this reason, the balance weight 15 does not need to be changed when the comb segment 16 is replaced with the cover 21.

(3) The cover 21 is formed of material having a greater specific gravity than the material of the comb segment 16. The cover 21 may be formed of the same material as the comb segments 16, but the flexibility in the shape of the cover 21 is improved by using the material having a great specific gravity.

The present embodiment is not limited to the above configuration, but may be modified as follows.

The comb segment 16 does not necessarily have to be replaced with the cover 21 with the bolt 18 loosened and the mounting member 19 left in the mounting slot 14*b*. Instead, for example, the comb segment 16 may be detached from the base 14 with the bolt 18 removed from the mounting member 19 and the mounting member 19 supported in the slot 16*b* of the comb segment 16. In this case, with the mounting member 19 supported in the slot 21*a* of the cover 21, the mounting portion 19*b* of the mounting member 19 is inserted in the mounting slot 14*b* of the base 14 in the next step. The bolt 18 is then inserted in the bolt through hole 17 to secure the cover 21 to the base 14.

Figure 3A:
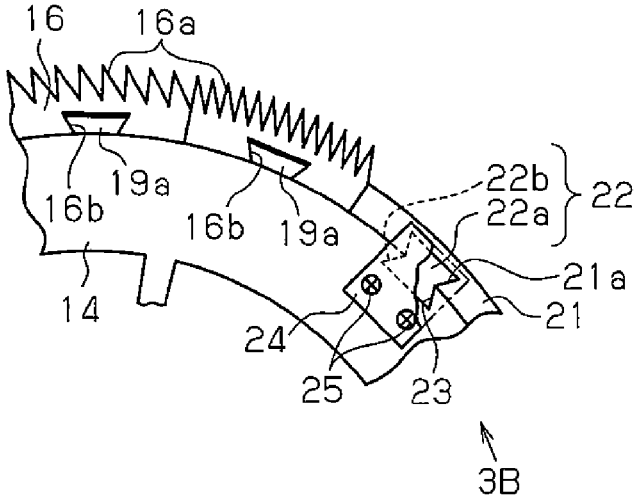
FIG. 3A is a partial side view illustrating the structure of a cover in a combing cylinder according to a second embodiment.
Figure 3B:
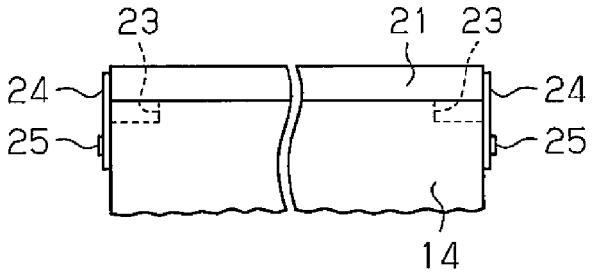
FIG. 3B is a schematic view illustrating FIG. 3A as seen from the direction of arrow 3B.

The structure for securing the cover 21 to the base 14 may differ from the structure for securing the comb segment 16 to the base 14. For example, FIGS. 3A and 3B show a second embodiment including fitting slots 23 formed in the base 14 at positions corresponding to the longitudinal ends of the associated mounting slot 14*b*. The fitting slots 23 are wider than the mounting slot 14*b*, and the width of the fitting slots 23 increases in the direction away from the cover 21. Cover mounting members 22 are prepared each of which includes a first fitting portion 22*a* that fits with the slot 21*a* of the cover 21 and a second fitting portion 22*b* that fits with the fitting slot 23. Each cover mounting member 22 is inserted in the slot 21*a* and the fitting slot 23 from the associated axial end of the base 14 with the cover 21 arranged such that the slot 21*a* and the fitting slot 23 face each other. As shown in FIG. 3B, a retainer plate 24 is secured to each side of the base 14 with screws 25 to prevent the cover mounting members 22 from falling off.

Figure 4:
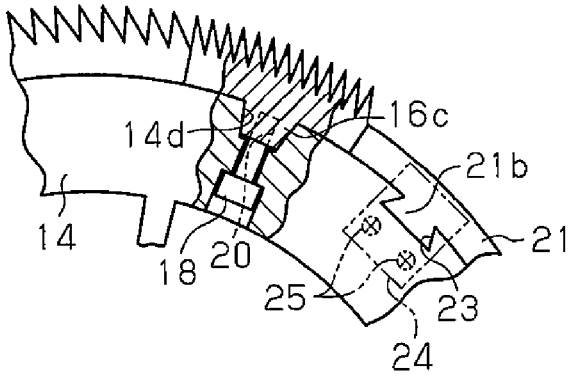
FIG. 4 is a partial side view illustrating a combing cylinder according to a third embodiment.
Figure 5:
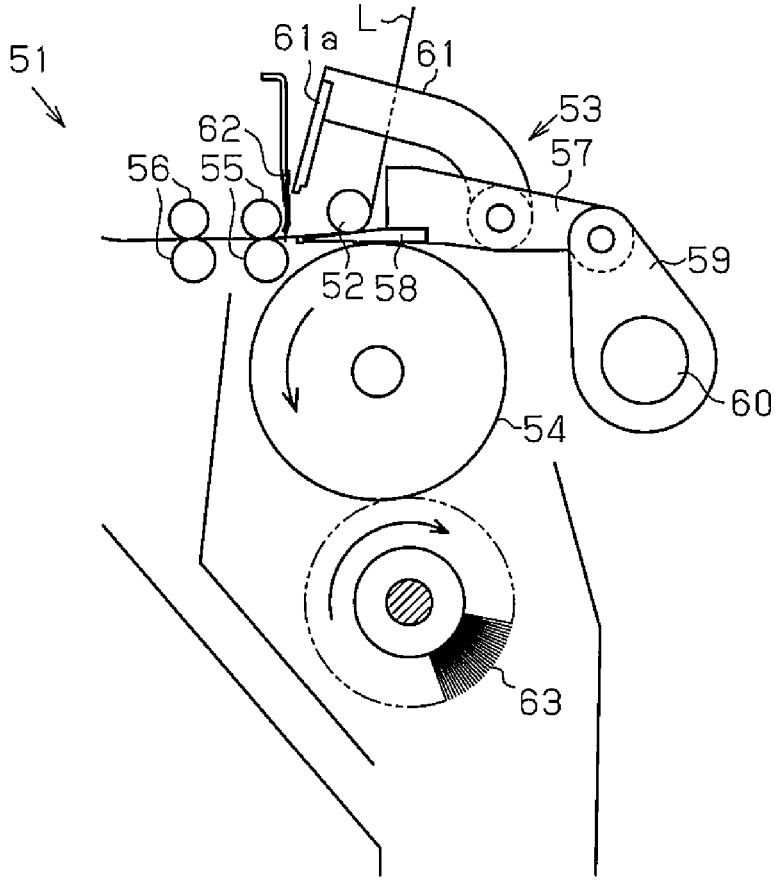
Fig.5(Prior Art)
FIG. 5 is a schematic side view illustrating a typical comber.
Figure 6:
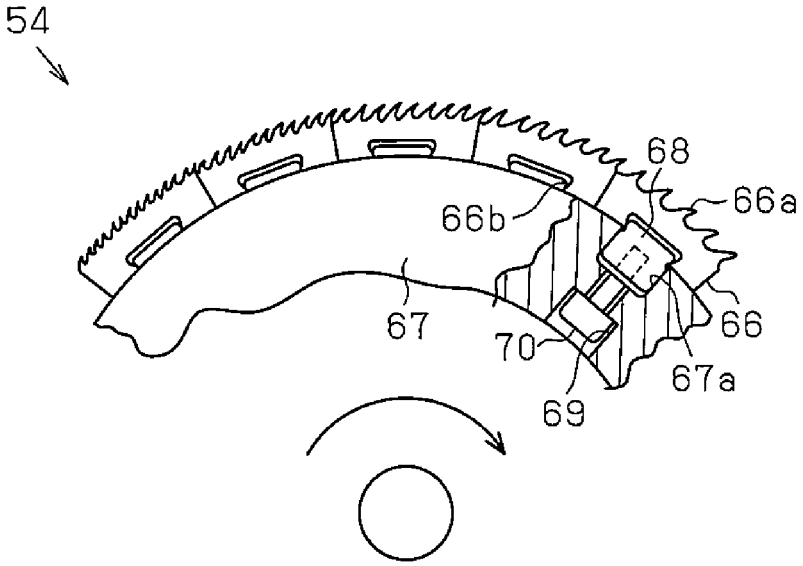
Fig.6(Prior Art)
FIG. 6 is a partial cross-sectional view illustrating the structure of a conventional combing cylinder.

As a third embodiment shown in FIG. 4, mounting slots 14*d* that narrow toward the axis of the base 14 may be formed on the outer circumference of the base 14. In this case, each comb segment 16 has a fitting portion 16*c* that fits with the associated mounting slot 14*d*. The fitting portion 16*c* is formed on the side of the comb segment 16 opposite the side where the needle array 16*a* is provided. The fitting portion 16*c* has a threaded bore 20 into which the bolt 18 is screwed. Like the structure of FIG. 3A, the base 14 has the fitting slots 23 at positions corresponding to the longitudinal ends of the associated mounting slot 14*b* to secure the cover 21 to the base 14. The width of the fitting slots 23 increases in the direction away from the cover 21. The cover 21 has, on its longitudinal ends, fitting portions 21*b* that fit with the fitting slots 23. The retainer plate 24 is secured to each side of the base 14 with the screws 25 to prevent the cover 21 from falling off.

It has been described that the cover 21 weighs the same as the comb segment 16, but the term "same" does not necessarily mean that the cover 21 and the comb segment 16 weigh exactly the same, but includes a case where the weights are slightly different. That is, the cover 21 only needs to have substantially the same weight as the comb segment 16 from the viewpoint of stabilizing the rotational balance. More specifically, the weight of the cover 21 is regarded as the same as the comb segment 16 if the weight difference between the cover 21 and the comb segment 16 is within a certain degree that does not hinder the rotational balance of the combing cylinder 11 without changing the balance weight 15 when the cover 21 is mounted on the base 14 instead of the comb segment 16.

The cover 21 does not need to weigh the same as the comb segment 16. In this case, the balance weight 15 is changed when the cover 21 is mounted instead of the comb segment 16 because it is necessary to adjust the rotational balance of the combing cylinder 11.

The upper limit of the number of the comb segments 16 mounted on the base 14 is five in the present embodiment, but may be six or more, and alternatively, four or less.

Multiple comb segments 16 may be detached from the base 14 at the same time, and may be replaced with multiple covers 21.

In each of the above embodiments, the combing needles 13 are configured by the comb segments 16 detachably secured to the base 14. Each comb segment 16 has the needle array (teeth) 16*a*, the size of which varies from one comb segment 16 to another. Instead of this, the combing needles 13 may be configured by an integrally formed comb segment, including multiple (for example, four) comb segments 16, that is detachably or undetachably secured to the base 14 and one or two comb segments 16 detachably secured to the base 14.

Therefore, the present examples and embodiments are to be considered as illustrative and not restrictive and the invention is not to be limited to the details given herein, but may be modified within the scope and equivalence of the appended claims.

The invention claimed is:

1. A combing cylinder for a comber, comprising:

a base including a plurality of mounting slots;

a plurality of comb segments each of which includes a needle array and is detachably secured to the base via the associated mounting slot, wherein size of the needle array for each of the plurality of comb segments vary from size of the needle array of at least one other comb segment among the plurality of comb segments; and a cover, wherein, when at least one of the plurality of comb segments is detached from the base, the cover is mounted on the base to cover the mounting slot corresponding to the detached comb segment, wherein the cover weighs the same as the detached comb segment, and wherein a height of the cover is less than a height of each of the plurality of comb segments.

2. The combing cylinder according to claim 1, wherein material of the cover has a greater specific gravity than the material of the comb segments.

* * * * *